United States Patent [19]

Frias

[11] Patent Number: 4,470,740

[45] Date of Patent: Sep. 11, 1984

[54] APRON FOR PIPE HANDLING SYSTEM

[75] Inventor: Robert Frias, Odessa, Tex.

[73] Assignee: Ingram Corporation, New Orleans, La.

[21] Appl. No.: 440,308

[22] Filed: Nov. 9, 1982

Related U.S. Application Data

[63] Continuation of Ser. No. 185,727, Sep. 15, 1980, abandoned.

[51] Int. Cl.[3] ..... E21B 19/14

[52] U.S. Cl. ..... 414/22; 414/748

[58] Field of Search ..... 414/22, 276, 745, 747, 414/748; 175/52, 85; 198/535, 536, 562, 865

[56] References Cited

U.S. PATENT DOCUMENTS

| | | | |
|---|---|---|---|
| Re. 24,907 | 12/1960 | Maydew | 414/22 |
| Re. 28,071 | 7/1974 | Smart | 414/745 |
| 2,335,719 | 11/1943 | Williams . | |
| 2,631,741 | 3/1953 | Tucker . | |
| 2,643,006 | 6/1953 | King . | |
| 2,656,052 | 10/1953 | Tucker . | |
| 2,896,796 | 7/1959 | Schuetz . | |
| 2,954,130 | 9/1960 | Krebs . | |
| 3,053,401 | 9/1962 | Jinkins . | |
| 3,159,286 | 12/1964 | Freeman . | |
| 3,559,821 | 2/1971 | James . | |
| 3,706,347 | 12/1972 | Brown . | |
| 3,780,883 | 12/1973 | Brown . | |
| 3,785,506 | 1/1974 | Crocker et al. | 414/22 X |
| 3,792,783 | 2/1974 | Brown | 414/22 |
| 3,810,553 | 5/1974 | Crocker . | |
| 3,916,500 | 11/1975 | Brown . | |
| 4,067,453 | 1/1978 | Moller . | |
| 4,235,566 | 11/1980 | Beeman . | |
| 4,347,028 | 8/1982 | Dugan | 414/22 |

*Primary Examiner*—Leslie J. Paperner

*Attorney, Agent, or Firm*—Lalos, Leeds, Keegan, Lett, Marsh, Bentzen & Kaye

[57] ABSTRACT

An elongated trough is slidably located on a vertically pivoted trough to carry pipe from a derrick floor to a pipe rack when there is little or no height differential between the derrick floor and the pipe rack. The slidable trough may be removed when the height differential is such that pipe will slide down the vertically pivoted trough by gravity.

13 Claims, 16 Drawing Figures

APRON FOR PIPE HANDLING SYSTEM

This application is a continuation of application Ser. No. 185,727, filed Sept. 10, 1980, now abandoned.

FIELD OF THE INVENTION

The present invention relates to a slidable apron for carrying pipe on the trough of a pipe handling apparatus.

DESCRIPTION OF THE PRIOR ART

Pipe handling systems have been employed for transferring pipe between a pipe rack and a derrick floor by means of a carriage which rolls on a track or by means of a trough in which the pipe slides. Systems of this type are disclosed in U.S. Pat. Nos. 2,335,719, 3,254,776, 3,494,483, Re. 28,071, 3,792,783, 3,810,553, 3,916,500, and 4,067,453.

SUMMARY OF THE INVENTION

It is an object of the present invention to provide an apparatus for transferring pipe between a derrick floor and pipe rack means and which comprises elongated structure slidable on a trough means for carrying pipe. In the embodiment disclosed, the trough means may be vertically pivoted to different heights. The elongated slidable structure is particularly useful for carrying pipe from the derrick floor when there is little or no height differential between the derrick floor and the support frame of the trough means. When there is a relatively great height differential between the derrick floor and the support frame of the trough means, the elongated slidable structure may be removed and the pipe allowed to slide down the trough means.

DESCRIPTION OF THE PREFERRED EMBODIMENTS

Figure 1:
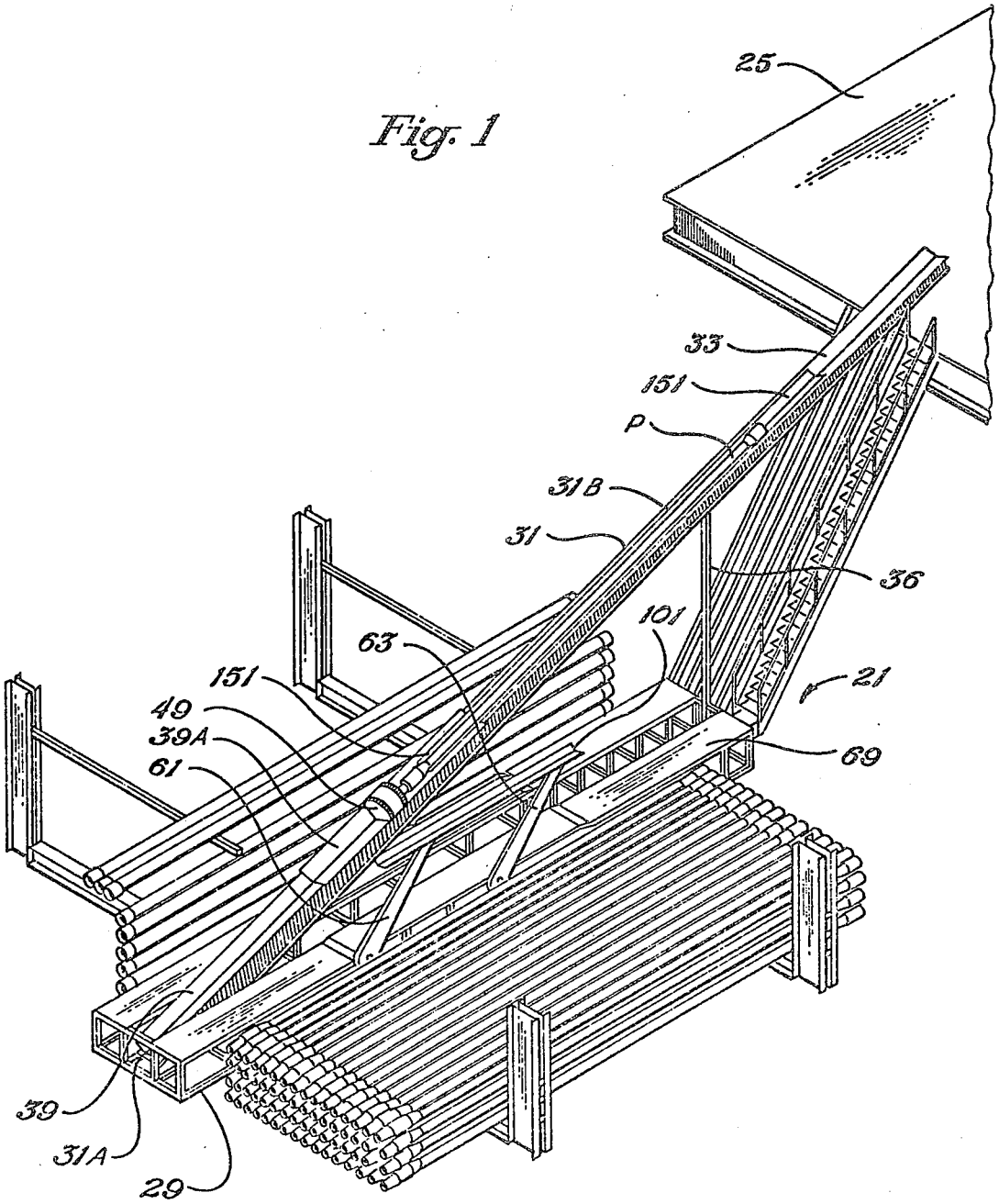
FIG. 1 is a perspective view of a pipe handling apparatus with a pipe transfer system located on one side of the apparatus next to a pipe rack.
Figure 9:
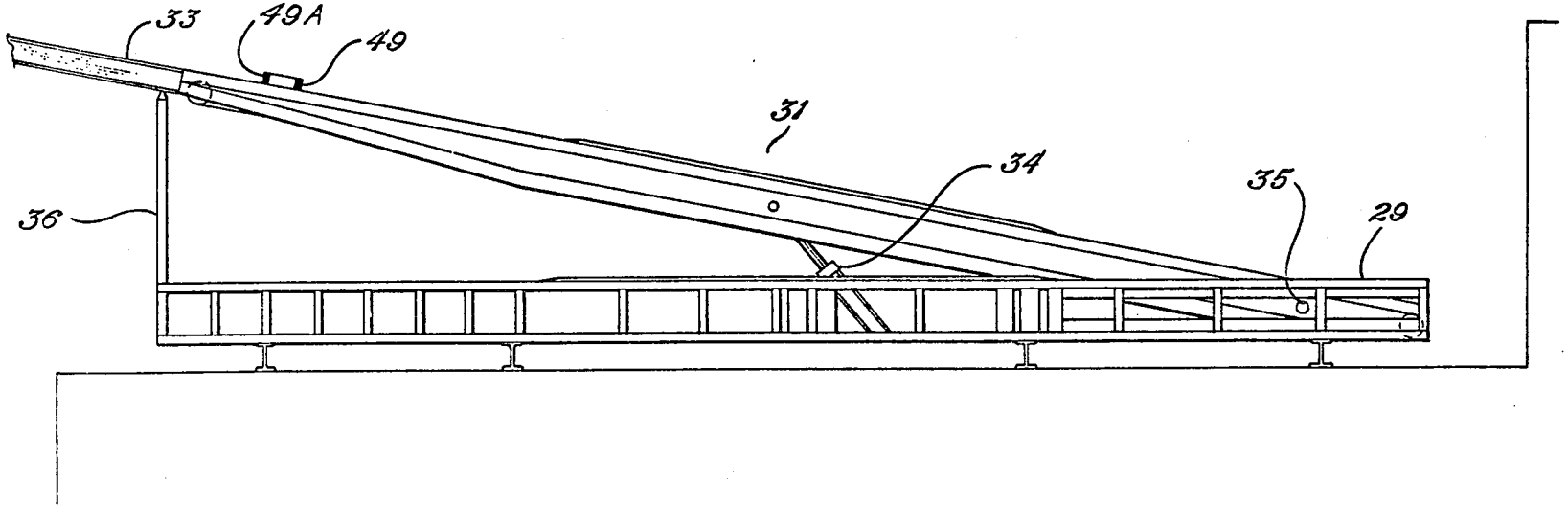
FIG. 9 is a side view of the vertically pivoted trough of the pipe handling apparatus of FIG. 1 showing the trough pivoted to an inclined position by hydraulic cylinders.
Figure 10:
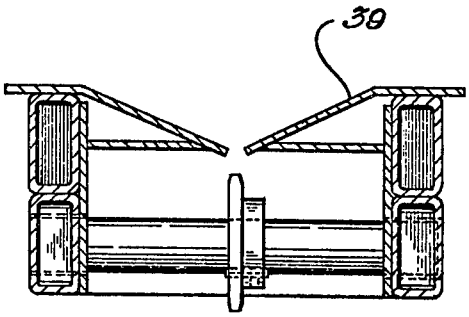
FIG. 10 is a cross-section of FIG. 8 taken along the lines 10—10 thereof.
Figure 11:
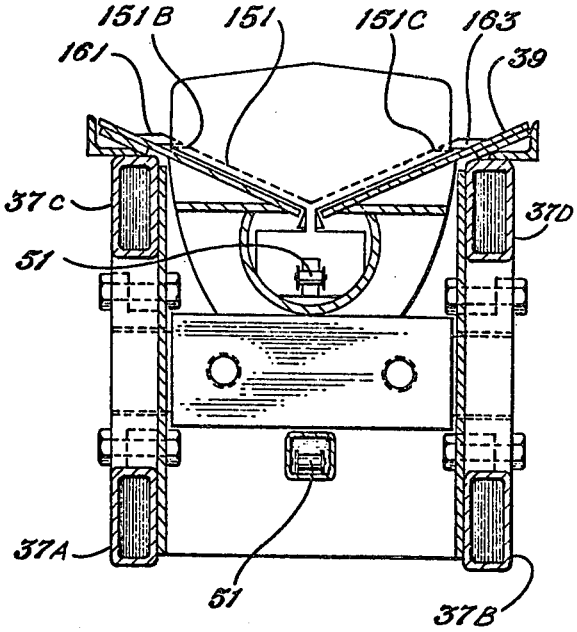
FIG. 11 is a cross-section of FIG. 8 taken along the lines 11—11 thereof.
Figure 12:
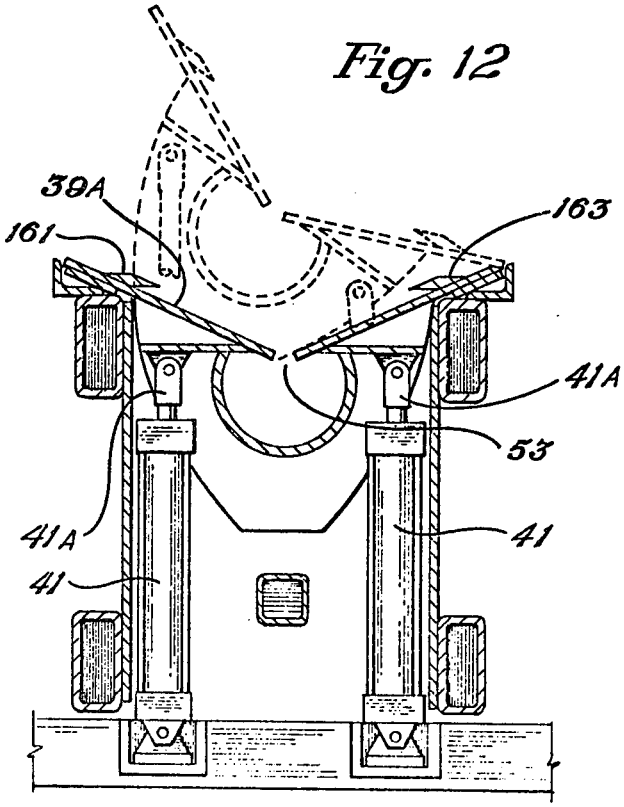
FIG. 12 is a cross-section of FIG. 8 taken along the lines 12—12 thereof.
Figure 13:
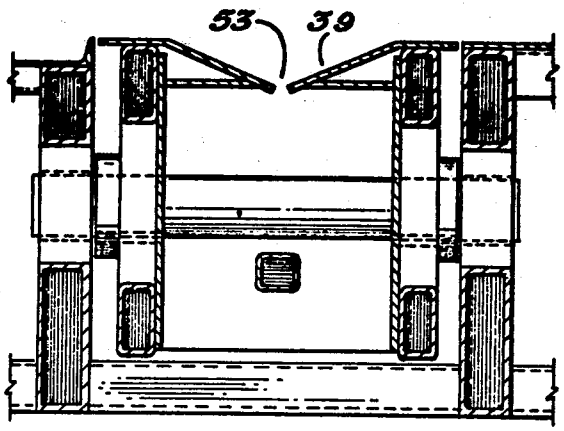
FIG. 13 is a cross-section of FIG. 8 taken along the lines 13—13 thereof.
Figure 16:
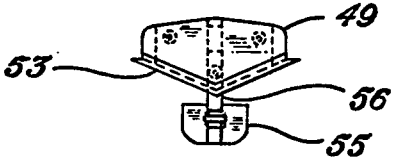
FIG. 16 is an end view of the pipe moving device of FIGS. 14 and 15.
Figure 14:
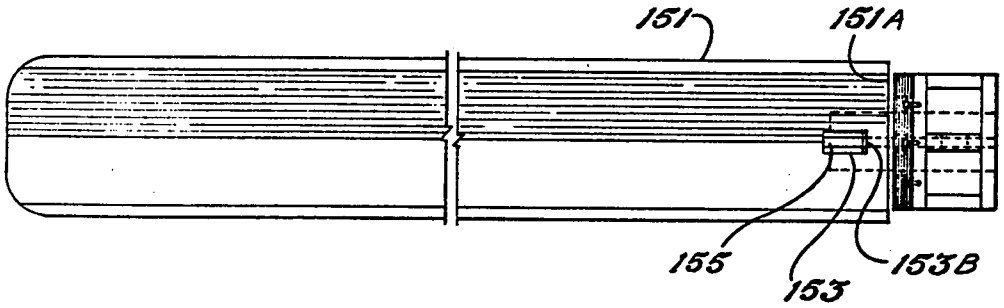
FIG. 14 is a top view of the slidable apron of the present invention attachable to the pipe moving device of the pipe handling apparatus of FIG. 1.
Figure 15:
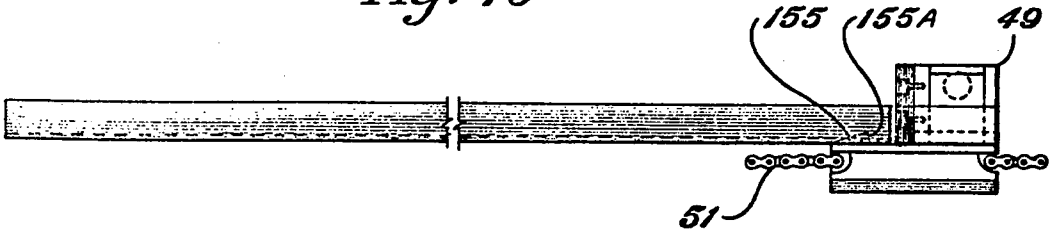
FIG. 15 is a side view of the apron and pipe moving device of FIG. 14.

Referring to the drawings, there will be described first the pipe handling apparatus 21 for raising pipe P such as casing, drill pipe, collars, or tubing up to a derrick floor 25 of a drilling rig (not shown) and for removing the pipe P from the derrick floor 25. The pipe P is stored in racks 27 on both sides of the apparatus 21. The apparatus 21 comprises an elongated frame 29 which supports a trough 31 which may be pivoted upward to an inclined position in alignment with a fixed trough 33 as shown in FIGS. 1 and 9 or downward to a horizontal position as shown in FIGS. 5 and 10-13. Hydraulic cylinders 34 are provided for pivoting the trough 31 upward and downward. The cylinders are pivotally attached to the frame 29 and their pistons are pivotally attached to the trough 31. The rear end of the trough 31 is pivotally coupled to the frame 29 at 35. The fixed trough 33 is supported in an inclined position by the derrick floor 25 and support structure 36. The trough 31 comprises elongated frame members 37A-37D which support a V-shaped floor 39 along which the pipe P slides. An intermediate portion 39A of the V-shaped floor 39 is tiltable laterally in either direction when the trough 31 is horizontal, to dump pipe on either side of the apparatus 21 for storage in the racks 27. The intermediate position 39A is tiltable by hydraulic cylinders 41. The cylinders 41 have their lower ends pivotally coupled to structure 43 which is connected to frame members 37A and 37B and their pistons 41A pivotally coupled to the intermediate portion 39A. FIG. 12 illustrates the intermediate portion 39A being tilted laterally to the left. The cylinders 49 move up and down with the trough 31 as it is pivoted up and down.

Also provided is a movable member 49 driven by an endless chain 51 for movement along trough 31 in either direction between its ends 31A and 31B. The bottom 53 of the movable member 49 is V-shaped and slides along the floor 39. The bottom of the floor 39 has an elongated slot 53 formed therethrough. A lug 55 having a thin neck 56 extends from the bottom of the movable member 49. The neck 56 extends through the slot 53 and the lug 55 is connected to the chain 51 below the floor 39. Means, not shown, is provided for driving the chain 51 in either direction.

When it is desired to move pipe from either of the racks 27 upward to the derrick floor, the following operations take place. The trough 31 is located in its horizontal position and the movable member 49 is located at the rear end 31A of the trough 31. A length of pipe is transferred from one of the racks 27 into the trough 31 where it rests on the V-shaped floor 39. Trough 31 next is pivoted upward to be in alignment with the fixed trough 33. The endless chain 51 is driven to move member 49 up the trough 31 to its end 31B. The front end 49A of member 49 engages the lower end of the pipe P and pushes the pipe P upward in the troughs 31 and 33 until the pipe overlies the derrick floor. The pipe then is lifted into the derrick by cable hoists and/or elevators. The member 49 is retracted to the rear end 31A of the trough 31; the trough 31 is lowered to a horizontal position; and the process is repeated.

In moving pipe downward from the derrick floor 25, the trough 31 is raised to be in alignment with the fixed trough 33 and member 49 moved to an upward position along trough 31. The cable hoist locates a length of pipe in troughs 33 and 31 and member 49 is moved downward to the lower end of trough 31 to allow the pipe to slide downward in the trough 31 to position the pipe on the intermediate portion 39A of the floor 39. The trough 31 then is lowered to a horizontal position and intermediate position 39A is tilted laterally to dump the pipe on either side of the apparatus 21 for storage in one of the racks 27.

Figure 2:
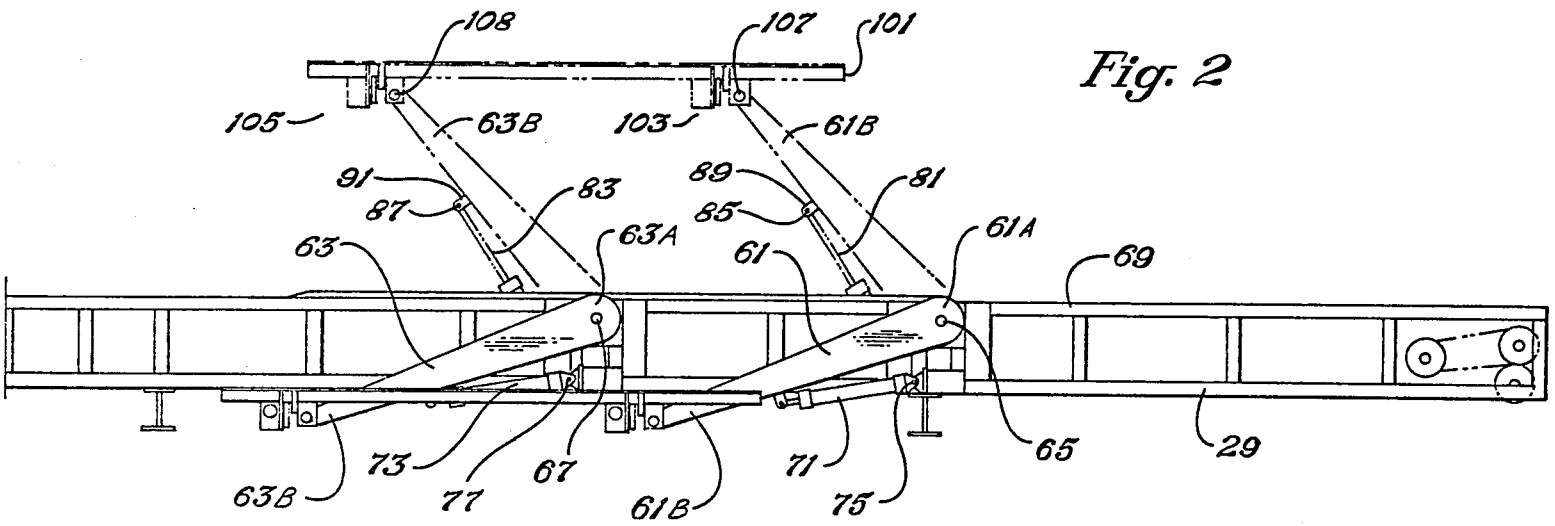
FIG. 2 is a side view of the pipe transfer system of FIG. 1.
Figure 4:
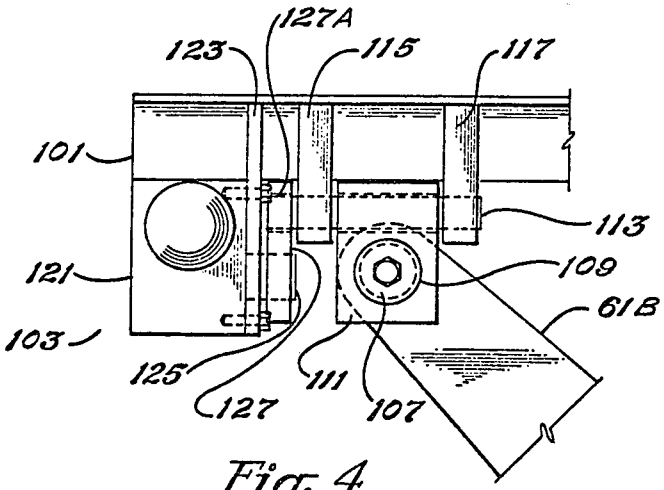
FIG. 4 is an enlarged side view of the tilting mechanism for the stacking and unstacking trough of the pipe transfer system of FIGS. 1 and 2.
Figure 5:
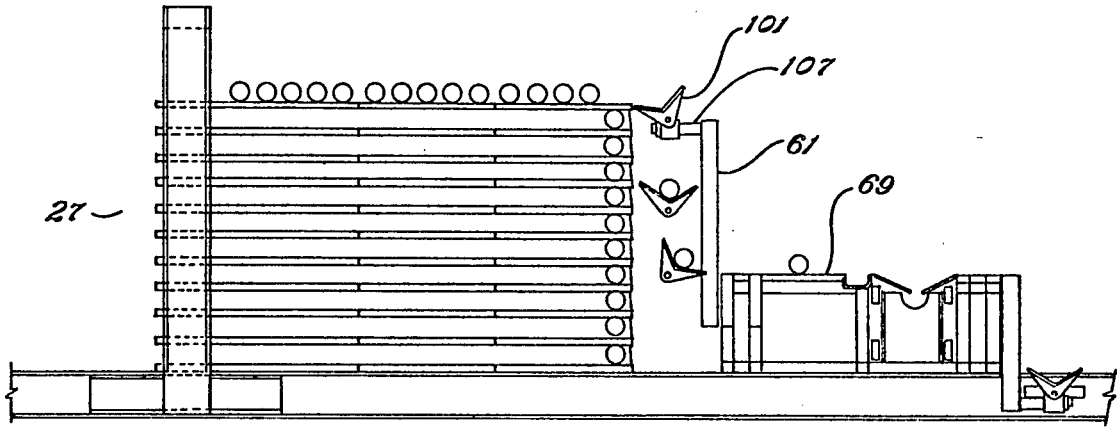
FIG. 5 is an end view of the pipe transfer system of FIGS. 1 and 2 with its stacking and unstacking trough shown at different elevations and positions.

The pipe transfer system for transferring pipe between the racks 27 and the pipe handling apparatus 21 comprises a pair of aligned arms 61 and 63 located on the side of the pipe handling apparatus 21 and next to one of the pipe racks 27. In FIG. 1, one pair of arms 61 and 63 are shown on the right of the apparatus 21 next to the right rack 27. The ends 61A and 63A of arms 61 and 63 are pivotally coupled to the frame 29 at 65 and 67. The opposite ends 61B and 63B of arms 61 and 63 may move to any upper position above the catwalk 69 and to a lower position below the catwalk 69 as shown in FIGS. 1, 2, and 5. In FIG. 2 the arms 61 and 63 are shown in dashed form in their upper positions.

Figure 6:
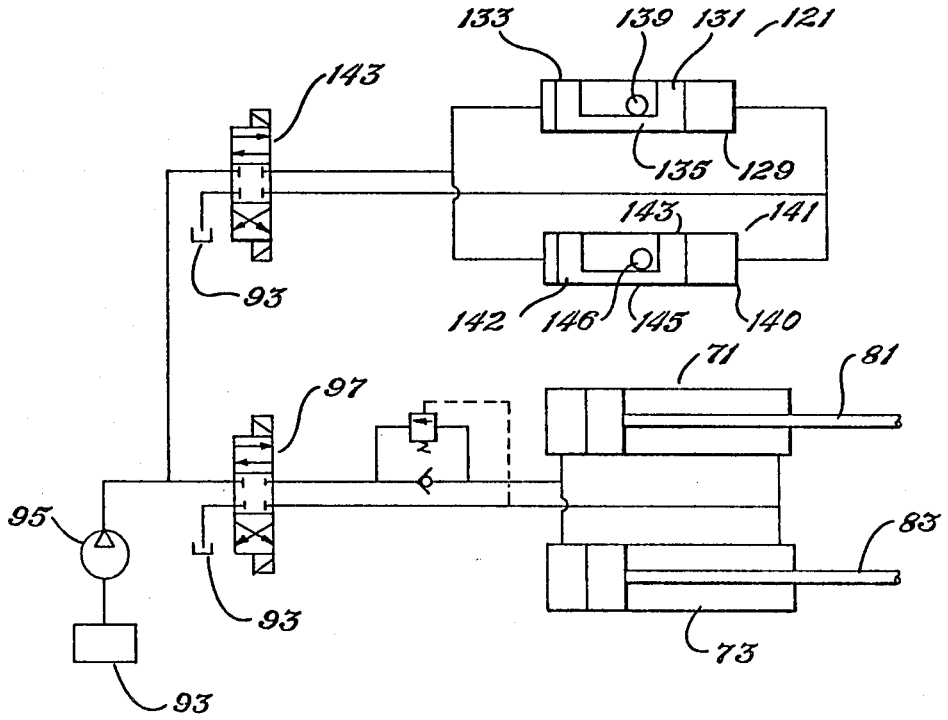
FIG. 6 illustrates a hydraulic system for operating the pipe transfer system of FIGS. 1-5.

A hydraulic system is employed for moving the ends 61B and 63B of arms 61 and 63 together to upward and downward positions or to any level in between. The hydraulic system comprises a pair of cylinders 71 and 73 having their ends pivotally coupled to the frame 29 at 75 and 77. The pistons 81 and 83 of the cylinders 71 and 73 are pivotally coupled to arms 61 and 63. In FIG. 2, the pistons 81 and 83 are shown pivotally coupled at 85 and 87 to ears 89 and 91 which are connected to arms 61 and 63 respectively. When the pistons 81 and 83 are forced outward of their cylinders, the ends 61B and 63B of arms 61 and 63 are moved upward and when the pistons 81 and 83 are moved inside of their cylinders, the ends 61B and 63B of arms 61 and 63 are moved downward. Referring to FIG. 6, the hydraulic system for operating the cylinders 71 and 73 comprises an oil reservoir 93, a pump 95, a four-way directional control valve 97 and appropriate flow lines.

Figure 3:
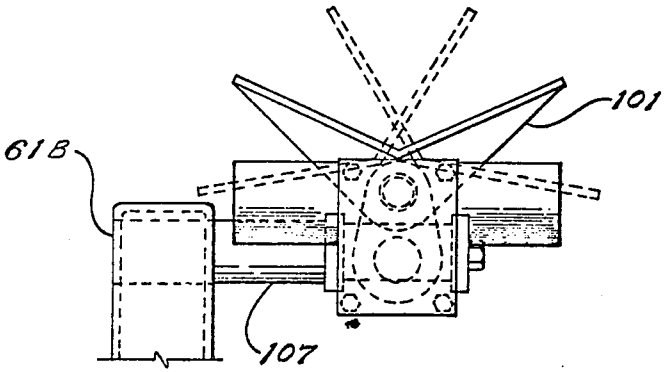
FIG. 3 is an enlarged end view of the tilting mechanism for the stacking and unstacking trough of the pipe transfer system of FIGS. 1 and 2.

Pivotally coupled to the ends 61B and 63B of arms 61 and 63 is a stacking and unstacking trough 101 for carrying pipe between the rack 21 and the pipe handling apparatus 21. The trough 101 can be pivoted laterally in either direction to allow pipe to be loaded onto and from the trough 101. Referring to FIGS. 2–6, the mechanisms for coupling the trough 101 to the ends 61B and 63B of the arms 61 and 63 and for tilting the trough 101 will be described. Tilting mechanisms 103 and 105 are provided at each end of the trough 101. The ends 61B and 63B of arms 61 and 63 have lugs 107 and 108 secured thereto respectively and which extend laterally outward. The lugs 107 and 108 are rotatably coupled to tilting mechanisms 103 and 105 respectively allowing the arms 61 and 63 to move up or down together carrying the length of the trough 101 in a horizontal position. Each of tilting mechanisms 103 and 105 is the same. Tilting mechanism 103 will be described in detail. The lug 107 is rotatably located in an aperture 109 formed through a bearing member 111. Member 111 is rotatably mounted on an upper shaft 113 which is supported by two mounts 115 and 117 fixedly secured to the trough 101. The shaft 113 freely extends through apertures 115A and 117A formed through mounts 115 and 117 and through aperture 111A formed through member 111 whereby the mounts 115 and 117 can rotate about the shaft 113 and the shaft 113 can rotate relative to member 111. A rotary actuator 121 is fixedly secured to the trough 191 by way of a plate 123 which is secured to the actuator 121 and to the trough 101. The actuator 121 has a lower shaft 125 which can be rotated in opposite directions. The lower shaft 125 is fixedly secured to a linkage 127 which is coupled to the shaft 113. The linkage 127 has an aperture 127A which freely receives the shaft 113 whereby the linkage can rotate about the shaft 113. When the actuator 121 rotates its shaft 125 in one direction, the linkage 127 is rotated causing the linkage to turn about the shaft 113 and hence tilt the actuator 121 and the trough 101. In FIG. 3, the trough 101 is shown in dotted lines tilted laterally in opposite directions. In FIG. 3, the actuator 121 is not shown tilting with the trough for purposes of clarity.

The rotary actuator 121 is a commercially available actuator hydraulically actuated. Referring to FIG. 6, it comprises a cylinder 129 having two pistons 131 and 133, with a rack 135 connected between the pistons. The rack 133 engages a pinion 139. The shaft 125 is an extension of the pinion 139. When pressure is imposed on one side of the cylinder 129 it drives the piston and the rack in one direction to rotate the pinion 139 and hence the shaft 125. On the opposite side of the cylinder the pressure is released. In FIG. 6, member 140 is the cylinder for the rotary actuator 141 for the tilting mechanism 105. Actuator 141 is the same as actuator 121. The cylinder 140 has two pistons 142 and 143 and a rack 145 connected between the pistons for rotating a pinion 146 from which extends a shaft similar to shaft 107. Both actuators of mechanisms 103 and 105 are operated simultaneously by hydraulic fluid from reservoir 93 and pump 95 for driving their shafts in the same direction for tilting the trough 101. Four way valve 143 is employed for controlling the direction in which the two actuators 121 and 141 rotate their shafts and hence the direction in which the trough 121 is tilted.

The arms 61 and 63 and trough 101 operate in the following manner to transfer pipe between the rack 27 and the pipe handling apparatus 21. Assume that pipe is to be transferred from apparatus 21 upward to the rack 27. The arms 61 and 63 will be located such that the trough 101 will be just below the catwalk 69 in a non-tilted position whereby the V of the trough 101 will be straight up. In this position, the upper edge of the trough 101 is located close to the catwalk 69 with very little space between the trough edge and the catwalk 69 such that pipe rolling outward on the catwalk 69 will roll into the trough 101. The intermediate position 39A of the floor 39 of the trough 31 is tilted laterally to dump a length of pipe onto the catwalk 69. From the catwalk, the pipe will roll into the trough 101. The arms 61 and 63 then are raised simultaneously to raise the trough 101 with the trough held in a non-tilted position. As the trough is raised, its length will be held horizontal. The trough thus will cradle and carry the pipe upward with no longitudinal movement of the pipe in the trough 101. Thus the pipe cannot roll off of the trough nor can it slide off of the trough longitudinally. When the trough 101 reaches the top of the rack 27, upward movement of the arms 61 and 63 will be terminated and the trough 101 will be tilted laterally in a direction to dump the length of pipe onto the top of the rack 27. The trough 101 will be moved to a non-tilted position and the arms 61 and 63 and trough 101 moved downward to repeat the process.

For transferring pipe from the rack 27 to the pipe handling apparatus 21, the arms 61 and 63 and trough 101 operate in the following manner. Assume that pipe is to be transferred from an upper row of pipe on the rack 27 to the pipe handling apparatus 21. The arms 61 and 63 will be located such that the trough 101 will be just below the top row of the pipe on the rack 27 with the trough 101 in a non-tilted position whereby the V of the trough 101 will be straight up. A length of pipe will be pushed into the trough 101. The arms 61 and 63 will then be lowered simultaneously with the trough 101 carrying the length of pipe downward in a horizontal position. When the trough 101 reaches the level of the catwalk 69, downward movement of the arms 61 and 63 will be terminated and the trough 101 will be tilted laterally in a direction to dump the length of pipe into the catwalk 69 where it will roll into the trough 31. The trough 101 will be moved to a non-tilted position and the arms 61 and 63 and trough 101 moved upward to repeat the process.

A pair of arms 61 and 63 and a laterally tiltable trough 101 as described above will be located on both sides of the apparatus 21 for transferring pipe between either rack 27 and the apparatus 21.

Figure 7:
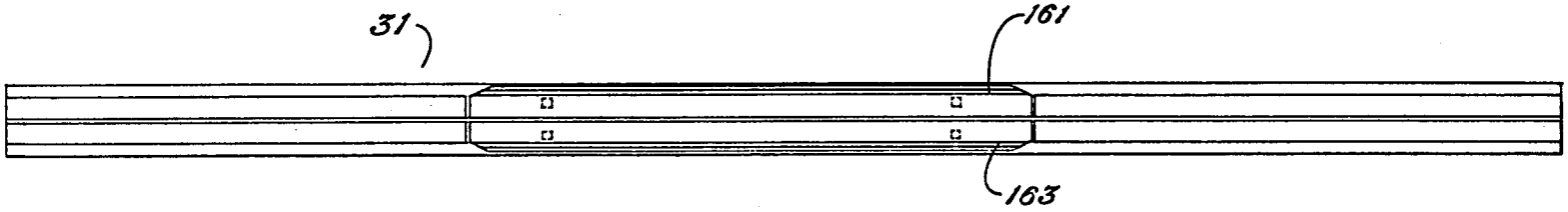
FIG. 7 is a top view of the vertical, pivoted trough of the pipe handling apparatus of FIG. 1.
Figure 8:
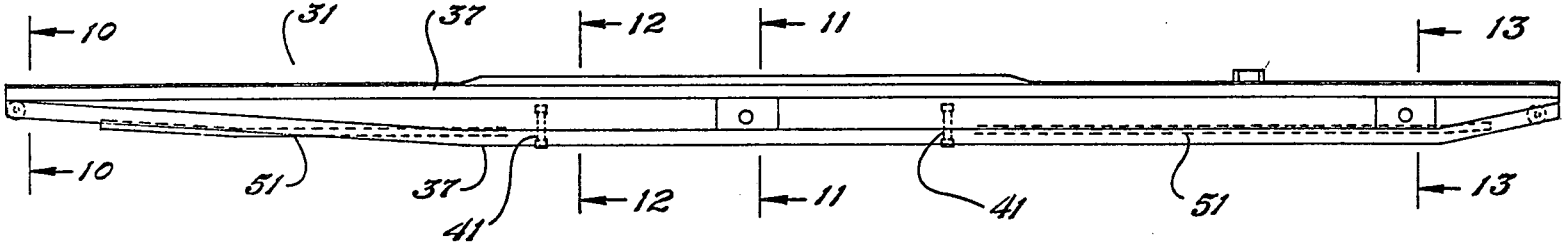
FIG. 8 is a side view of the vertically pivoted trough of the pipe handling apparatus of FIG. 1.

When the incline of the troughs 31 and 33 is small, the pipe may not slide down the trough from the derrick floor by gravity. Referring now to FIGS. 1, 7, 8, 11, 12, and 14–16, there will be described a slidable apron 151 removably attachable to the pipe moving device 49 of the pipe handling apparatus 21 for carrying pipe from the derrick floor 25 down the troughs 33 and 31 when there is little or no height differential between the derrick floor 25 and the frame 29 of the pipe handling apparatus 21. The apron 151 comprises a V-shaped member slidable on the floor 39 of the trough 31. An aperture 153 is formed close to the rear end 151A of the apron 151 into which is fitted a triangular shaped securing member 155 which projects upward from a forward extension of the neck 56 of member 49. The aperture 153 does not extend all of the way to the rear end 115A of the apron 151 but is spaced therefrom a short distance. The member 153 slants downward toward its forward end whereby the member 155 may be inserted into the aperture 153 by moving the member 49 forward while the apron 151 is held stationary. The rear end of the apron 151 will ride upward on the member 155 as it moves forward until it reaches full length of the aperture 153 at which time the apron will drop down with the member 155 located in the aperture 153. When the member 49 is moved forward by the chain, its front end 49A will engage the rear end 151A of the apron and push the apron 151 forward along the trough 31. For drawing pipe from the derrick floor, the apron 151 will be pushed onto the fixed trough 33. A length of pipe will be loaded onto the apron 151 and the member 49 will be moved backward by the chain 51 pulling the apron 151 and hance the pipe backward whereby the pipe may be loaded onto the rack 27. When the member 49 moves backward the rear end 155A of the member 155 engages the rear end 153B of the aperture 153, pulling the apron 151 backward. As seen in FIGS. 7, 11, and 12, the intermediate or dump portion 39A of the floor 39 of the trough 31 has two elongated apron holding strips 161 and 163 formed along its top outer edges. When the apron 151 is pulled onto the intermediate portion 39A, the outer edges 151B and 151C of the apron slide under the strips 161 and 163 whereby the apron is held to the intermediate or dump portion 39A. Thus when the trough 31 is lowered to a horizontal position and the dump portion 39A is pivoted laterally, the apron 151 also will be tilted laterally allowing the pipe to be dumped onto the catwalk 69 for loading onto a rack 27 next to the apparatus 21. During dumping operations by the dump portion 39A, member 49 will not be located above the dump portion 39A. When the apron 151 is tilted laterally by the dump portion 39A, its aperture 153 is moved above the member 155. However, when the apron is moved back in place by the dump portion 39A, the aperture 153 will fit around the member 155 whereby the movable member 49 may push the apron along the trough 31 to the fixed trough 33.

Although the apron 151 is used primarily for drawing pipe from the derrick floor for loading on the rack, it is to be understood that it could be used for moving pipe from the rack 27 to the derrick floor. The apron 151 also has advantages in that it protects the main troughs 31 and 33 from wear. A teflon like coating may be applied to the underside of the apron 151 to minimize friction.

When the height differential between the derrick floor 25 and the frame 29 is sufficient such that the pipe will slide down troughs 33 and 31 by gravity, the apron 151 may be removed as well as the securing member 155. Member 155 may be removably secured to the forward extension of the neck 56 of member 49 by bolts.

Instead of employing the strips 61 and 63 to hold the apron 151 to the dump portion 39A, the apron 151 may have a thin neck extending down from its bottom with an enlarged lug attached to the thin neck. The thin neck will extend through the slot 53 with the enlarged lug located below the floor 39. This arrangement allows the apron 151 to slide on the floor 39 yet holds the apron 151 to the dump portion when it is tilted for dumping purposes. In this embodiment, the apron 151 may be coupled to the member 49 by securing member 155 to the forward extension of the neck 56 of member 49 through the aperture 153 of the apron 151 when the aperture 153 of the apron 151 is over the forward extension of the neck. The apron 151 may be removed by removing member 155 and by sliding the apron forward when the trough 31 is at a slightly inclined position to remove the lower thin neck of the apron from the slot 53 at the forward end of the trough 31.

Preferably the apron 151 will be longer than the length of pipe it will carry.

I claim:

1. An apparatus for transferring pipe or the like between the floor of a drilling rig and a pipe rack means comprising:

an elongated main support frame adapted to be located close to the pipe rack means, an elongated pivotal trough means having one end pivotally coupled to said main support frame such that said pivotal trough means can be pivoted upward to an inclined position relative to said main support frame and toward said drilling rig floor and downward to a generally horizontal position, a portion of said pivotal trough means adjacent said pipe rack means comprises a dump trough means, said dump trough means being adapted to support a length of pipe, a tilting means for tilting said dump trough means when said pivotal trough means is in a generally horizontal position, whereby pipe can move laterally between said pivotal trough means and said pipe rack means when in a tilted position and said dump trough means is generally flush with the rest of said pivotal trough means when in an untilted position, a pivoting means for pivoting said pivotal trough means between said inclined position and said generally horizontal position, a movable elongated structure adapted to receive and carry pipe and supported for lengthwise sliding movement in said pivotal trough means, a moving means for moving said movable elongated structure along the length of said pivotal trough means, a coupling means for coupling said elongated structure to said moving means, and a holding means for holding said elongated structure to said dump trough means to allow said elongated structure to tilt with said dump trough means.

2. The apparatus of claim 1 including, said holding means allowing said elongated structure to said lengthwise relative to said dump trough means.

3. The apparatus of claim 2 including, said holding means including a holding strip means attached to the upper surface of said dump trough means.

4. The apparatus of claim 3 including, said holding strip means comprising a pair of opposed guide members positioned to engage the outer edges of said elongated structure.

5. The apparatus of claim 1 including, said pivotal trough means including a V-shaped pipe support floor, and said elongated structure being supported by and sliding on said pipe support floor.

6. The apparatus of claim 5 including, said holding means holding said elongated structure to said pipe support floor when said elongated structure is positioned on said dump trough means.

7. The apparatus of claim 5 including, said holding means including a holding strip means attached to said support floor on said dump trough means.

8. The apparatus of claim 1 including said holding means including, said pivotal trough means including a pipe support floor on which said elongated structure slides, a neck member attached to and depending from said elongated structure, said neck member passing through an opening in said pipe support floor, and a lug means attached to the outer end of said neck member and positioned to engage a lower surface of said pipe support floor.

9. An apparatus for transferring pipe or the like between the floor of a drilling rig and a pipe rack means comprising:

an elongated main support frame adapted to be located close to the pipe rack means, an elongated pivotal trough means having one end pivotally coupled to said main support frame such that said pivotal trough means can be pivoted upward to an inclined position relative to said main support frame and toward said drilling rig floor and downward to a generally horizontal position, a portion of said pivotal trough means adjacent said pipe rack means comprises a dump trough means, said dump trough means being adapted to support a length of pipe, a tilting means for tilting said dump trough means when said pivotal trough means is in a generally horizontal position, whereby pipe can move laterally between said pivotal trough means and said pipe rack means when in a tilted position and said dump trough means is generally flush with the rest of said pivotal trough means when in an untilted position, a pivoting means for pivoting said pivotal trough means between said inclined position and said generally horizontal position, a movable elongated structure adapted to receive and carry pipe and supported for lengthwise sliding movement in said pivotal trough means, a moving means for moving said movable elongated structure along the length of said pivotal trough means, and a coupling means for coupling said elongated structure to said moving means, said coupling means including a removable coupling means for uncoupling said moving means from said elongated structure when said elongated structure is positioned on said dump trough means and said tilting means tilts said dump trough means.

10. The apparatus of claim 9 including, said removable coupling means including an aperture means formed through the bottom of said movable elongated structure near one end thereof, and a securing means connected to said moving means and extending upward, said securing means being adapted to be removably fitted into said aperture means from below the bottom of said movable structure.

11. An apparatus for transferring pipe or the like between the floor of a drilling rig and a pipe rack means comprising:

an elongated main support frame adapted to be located close to the pipe rack means, an elongated pivotal trough means having one end pivotally coupled to said main support frame such that said pivotal trough means can be pivoted upward to an inclined position relative to said main support frame and toward said drilling rig floor and downward to a generally horizontal position, a portion of said pivotal trough means adjacent said pipe rack means comprises a dump trough means, said dump trough means including an elongated tilting tray adapted to support a length of pipe, a tilting means mounted to said pivotal trough means for tilting said dump trough means when said pivotal trough means is in a generally horizontal position, whereby pipe can move laterally between said pivotal trough means and said pipe rack means when in a tilted position and said dump trough means is generally flush with the rest of said pivotal trough means when in an untilted position, a pivoting means for pivoting said pivotal trough means between said inclined position and said generally horizontal position, said elongated pivotal trough means having a pivot axis fixed to said main support frame and a second end unsupported during pivotal movement, said pivoting means causing said second end to travel an arc having a center coincident with said pivot axis, said pivoting means being connected to said pivotal trough means intermediate said ends, said pivoting means including a fluid actuated cylinder means coupled at one end to said support frame and at the other end to said pivotal trough means, a movable elongated structure adapted to receive and carry pipe and supported for lengthwise sliding movement in said pivotal trough means, a moving means for moving said movable elongated structure along the length of said pivotal trough means, and a coupling means for coupling said elongated structure to said moving means.

12. An apparatus for transferring pipe or the like between the floor of a drilling rig and a pipe rack means comprising:

an elongated main support frame adapted to be located close to the pipe rack means, an elongated pivotal trough means having one end pivotally coupled to said main support frame such that said pivotal trough means can be pivoted upward to an inclined position relative to said main support frame and toward said drilling rig floor and downward to a generally horizontal position, a portion of said pivotal trough means adjacent said pipe rack means comprises a dump trough means, said dump trough means being adapted to support a length of pipe, a tilting means for tilting said dump trough means when said pivotal trough means is in a generally horizontal position, whereby pipe can move laterally between said pivotal trough means and said pipe rack means when in a tilted position and said dump trough means is generally flush with the rest of said pivotal trough means when in an untilted position, said tilting means including an extendable means connected at one end to said pivotal trough means and at the other end to said dump trough means for tilting said dump trough means selectively to either side of said pivotal trough means, a pivoting means for pivoting said pivotal trough means between said inclined position and said generally horizontal position, a movable elongated structure adapted to receive and carry pipe and supported for lengthwise sliding movement in said pivotal trough means, a moving means for moving said movable elongated structure along the length of said pivotal trough means, and a coupling means for coupling said elongated structure to said moving means, said pivotal trough means including at least two spaced longitudinal frame members, said extendable means being connected to pivotal trough means at a location inside said frame members and to said dump trough means at a location between said frame members, said extendable means including a pair of cylinder means attached on opposite sides of said dump trough means, a cylinder connection means attached to and positioned below said dump trough means and between said frame members, said pair of cylinder means including a first cylinder pivotally coupled at one end to said pivotal trough means and a second end pivotally coupled to said cylinder connection means and a second cylinder pivotally coupled at one end to said pivotal trough means and a second end pivotally coupled to said cylinder connection means, and said cylinder means being adapted so that when said first cylinder second end extends relative to said first cylinder first end to cause said dump trough means to tilt said second cylinder second end extends relative to said second cylinder first end but a lesser extension distance than said first cylinder second end extends.

13. The apparatus of claim 12 including, said cylinder connection means including a horizontal plate means.

* * * * *